United States Patent [19]

Long

[11] Patent Number: 4,700,395

[45] Date of Patent: Oct. 13, 1987

[54] RECREATIONAL COOLER AND SPEAKER SYSTEM

[76] Inventor: Bill Long, 1112 Dayton Ave., San Carlos, Calif. 94070

[21] Appl. No.: 729,749

[22] Filed: May 1, 1985

[51] Int. Cl.[4] ..... H04R 1/02; H04R 3/12; F25D 3/08

[52] U.S. Cl. ..... 381/90; 381/90; 381/99; 62/371; 62/457; 62/529

[58] Field of Search ..... 381/90, 87, 88, 99, 381/188, 205; 179/146 R, 146 E, 184; 62/457, 371, 529, 531; 455/351

[56] References Cited

U.S. PATENT DOCUMENTS 4,279,342 7/1981 Van Pelt ..... 62/457
4,489,770 12/1984 Reich, II ..... 381/159
4,562,590 12/1985 DeLage ..... 381/90
4,571,740 2/1986 Kirby et al. ..... 455/351

FOREIGN PATENT DOCUMENTS 298818 10/1928 United Kingdom ..... 179/146 R
697135 9/1953 United Kingdom ..... 179/146 E
1039051 10/1953 United Kingdom ..... 179/146 E

*Primary Examiner*—Gene Z. Rubinson
*Assistant Examiner*—Danita R. Byrd
*Attorney, Agent, or Firm*—Donald L. Beeson

[57] ABSTRACT

A recreational cooler and speaker system includes an audio signal input terminal, such as an audio jack, on an outer wall of the cooler for driving speaker elements mounted to the cooler enclosure through an electrical path within the enclosure walls.

6 Claims, 5 Drawing Figures

RECREATIONAL COOLER AND SPEAKER SYSTEM

BACKGROUND OF THE INVENTION

The present invention relates to recreational equipment used for picnics, boating, camping and the like, and more particularly to the use of portable coolers that store and transport foods and beverages.

Portable coolers that are compact and lightweight enjoy widespread use for all types of recreational activities where perishable foods and beverages need to be transported and stored. Also finding widespread use in the same recreational environment are miniature radios and other miniature audio systems, such as mini-cassette players. Indeed, it would not be uncommon to find a picnicker carrying a cooler in one hand and his or her portable audio system in another. In the present invention a portable cooler and speakers are uniquely combined into a single combined system that can be easily transported. In addition, the recreational cooler and speaker system of the invention is easy to use, can be manufactured at low cost or produced by converting commercially available coolers, and is intended for use with a broad range of cooler sizes, typically 15 quart to 100 quart coolers.

SUMMARY OF THE INVENTION

The invention is specifically a recreational cooler and speaker system comprised of an enclosure having outer bottom, side and endwalls, and an interior storage compartment. At least one speaker element is mounted in one of the enclosure sidewalls such that sound from the speaker element can be directed forwardly of the speaker sidewall into a listening area adjacent the cooler. The illustrated embodiments include the use of two five inch, full range, four ohm speakers mounted side by side in the cooler sidewall, for providing two channel stereophonic sound. Also described and illustrated is a two channel, two-way speaker system with each channel having low and high frequency speaker elements such as a six inch woofer and a two inch mid-range, high frequency tweeter. It will readily be understood from the description herein that other speaker configurations could be devised within the scope of the invention, such as, for example, a 3-way speaker system for each channel, or systems using other speaker element sizes.

An electrical conductor path is provided within the enclosure for receiving an audio signal and driving the speaker elements mounted to the enclosure sidewalls. In the preferred embodiment the electrical conductor path consists of electrical wiring which runs between the walls of the cooler enclosure, i.e. between the enclosure's outer side and endwalls and the inner storage compartment wall. Also, in the preferred embodiment, the speakers are wired to an external audio signal input terminal mounted to an outer wall of the cooler enclosure. As illustrated, an external audio jack is preferrably provided through the swivel axis of the cooler's swivel lid. In another embodiment of the invention the speakers are wired to an amplifier or to complete audio components built into the cooler.

Therefore, it can be seen that the primary object of the invention is to provide a portable cooler which also provides the recreational user with an audio speaker system. A further object of the invention is to provide such a combined cooler and speaker system that can be connected to commercially available low power, miniature stereo systems, such as miniature radios and cassette players. The invention in the illustrated and described embodiment can be used with a Sony Walkman or the like by plugging same via lead wires and a plug connector, directly into the cooler and speaker system of the invention.

The preferred embodiment of the invention will now be described in further detail with reference to the following drawings:

DETAILED DESCRIPTION OF ILLUSTRATED EMBODIMENTS

Figure 1:
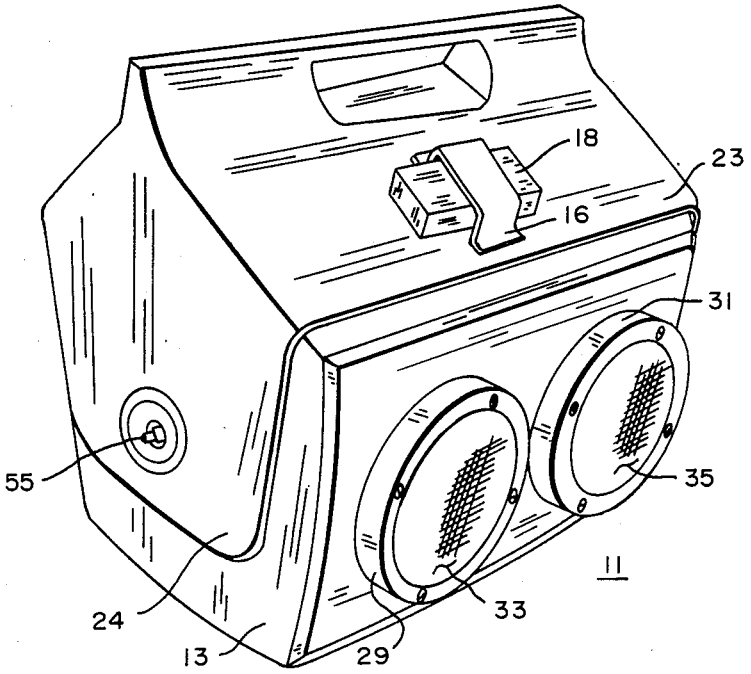
FIG. 1 is a perspective view of a recreational cooler and speaker system in accordance with my invention.

Referring now to the drawings, a recreationsl cooler and speaker system, generally designated by the numeral 11, is comprised of an enclosure having a bottom wall 15, sidewalls such as the shown front sidewall 17, and endwalls 19, 21. An enclosure lid 23 having swivel extensions 24, 26 is attached to the enclosure at swivel points 25, 27 which form a swivel axis A about which the lid 23 can be swivelled down to an open position. A retaining strap 16 can be secured to the top of the lid by means of rivets or the like for holding a miniature audio source device 18 such as a mini-cassette player.

Figure 3:
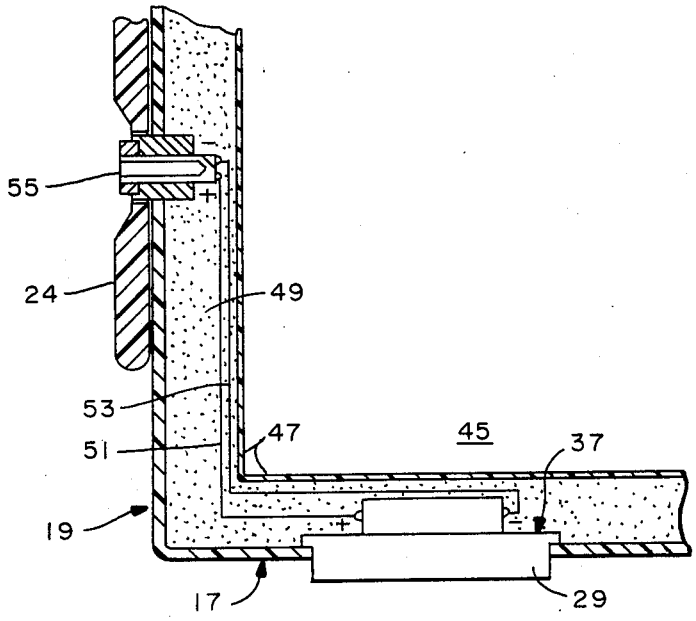
FIG. 3 is a partial cross-sectional, pictorial view of the recreational cooler and speaker system illustrated in the foregoing drawings, showing the wiring of a speaker element to an endwall audio jack.

With reference to FIG. 3, the coolers interior storage compartment 45 is formed by interior compartment walls 47, with the space between the interior compartment walls 47 and the other enclosure walls 15, 17, 19, 21 being filled with a suitable wall insulating material 49. As best seen in FIGS. 1 and 3, the speaker elements 29, 31 are mounted in one of the enclosure sidewalls 17 such that the front 33, 35 of each speaker points outwardly from the enclosure sidewall to direct sound forwardly of the cooler into an adjacent listening area. The back of the speaker projects through the cooler sidewall into the interior wall space containing the wall insulating material 49. The thickness of the speaker compared with the interior to outer wall thickness of the cooler will generally require the speakers to protrude somewhat from the cooler sidewall, however, flush mounted speakers might be possible using a relatively thin reverse magnet speaker elements. Generally, the speaker thickness should be no more than $1\frac{1}{8}$ inches. The speakers should also be backed with a moisture impervious material such as plastic film to keep moisture from building up on the backs of the speakers. This will also reduce the amount of acoustial energy absorbed by the wall insulating material 49. To prevent water leakage from the ouside, each speaker should also be sealed, for example with a silicon sealer, where the speaker contacts the outer wall of the enclosure.

Preferably four ohm speakers will be used instead of eight ohm speakers since it takes less power to drive a four ohm speaker. Four ohm speakers can be driven from low power signal sources such as a miniaturized radio receiver or cassette player.

Figure 2:
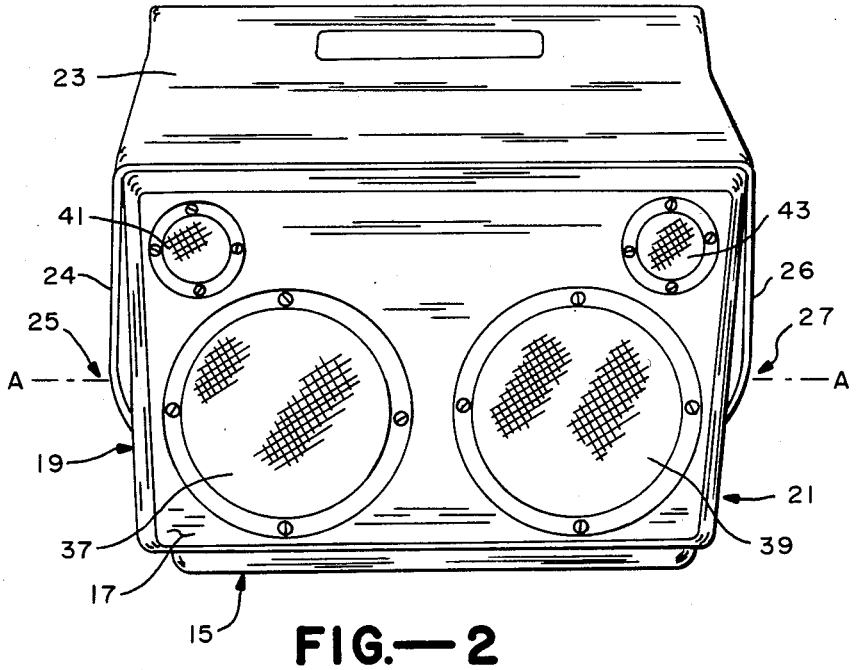
FIG. 2 is a front elevational view of the recreational cooler and speaker system shown in FIG. 1, further showing the use of four speaker elements as opposed to two speaker elements.

The use of two speaker elements 29, 31 are shown in FIG. 1. Such a two speaker arrangment can be used for two channel stereo sound using suitable full range speaker elements that fit on a conventionally size cooler, such as two 5" diameter, four ohm, full range speakers. Alternatively, as shown in FIG. 2, a two-way system can be provided using two low frequency 6" diameter speakers 37, 39, commonly referred to as "woofers", and two smaller mid-range, high frequency "tweeters" 41, 43.

An electrical conductor path to the speaker elements mounted in the sidewall of the enclosure can suitably be provided in the space between the inner storage compartment 47 and outer enclosure walls 17, 19. In the illustrated embodiment, the conductor path is provided in the form of conductor wires, 51, 53, typically 20 gauge copper wire, which are connected to an external signal input terminal in the form of a audio jack 55. A $\frac{1}{8}$" female mini stereo jack can be used, the common and positive leads of which are connected to the positive and negative leads in back of the speaker elements.

The audio jack 55 is shown to be disposed on the enclosure's swivel axis; it extends through the lid's left hand swivel extension 24 and into the enclosure's endwall 19 so as to provide a swivel bearing for the enclosure lid. To facilitate the swivel action of the lid and to prevent the jack from being rotated with the lid, a suitable nylon collar 54 can be placed around the jack.

The audio jack provides a convenient signal input terminal at the exterior of the cooler enclosure, an input terminal that is unobtrusively located and that can easily be connected to through conventional male connector plugs and that can be installed on existing cooler designs at minimum expense while preserving the integrity of the cooler enclosure. The jack is also disposed well above the ground on which the cooler normally sits so the chance of foreign matter interferring with the jack is reduced. It will readily be appreciated, however, that other signal input terminal devices might be employed such as a terminal strip mounted to and wired through the side, end, or bottom wall of the cooler.

Figure 4:
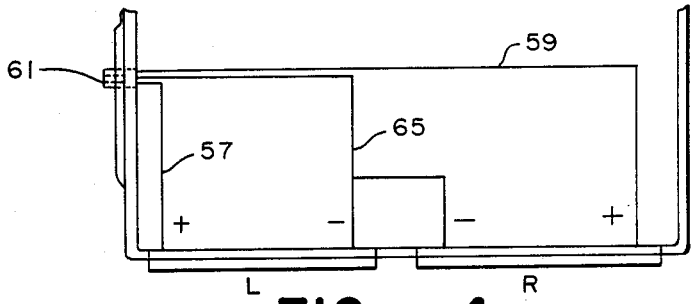
FIG. 4 is a wiring diagram for a two speaker element version of the invention.
Figure 5:
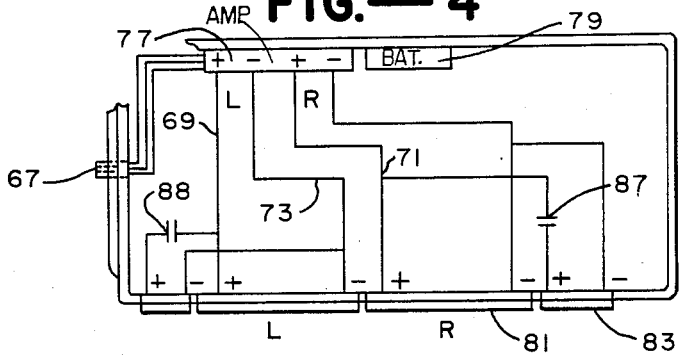
FIG. 5 is a wiring diagram for a two channel, two-way speaker system version of the invention employing a built-in amplifier and battery pack.

FIGS. 4 and 5 illustrate, pictorially, alternative wiring schemes for a cooler having, respectively, two full range, two channel speakers such as illustrated in FIG. 1, and a two way system with four speaker elements such as illustrated in FIG. 2. Referring to FIG. 4, the conductor paths from left and right speakers, designated L and R, consist of two positive lead wires 57, 59 wired to a stereo audio jack 61 in the cooler sidewall 63 and a common negative lead wire 65 connected to the common terminal of the stereo jack. Similarly, the left and right channel speakers L and R of the FIG. 5 embodiment are wired to a similarly positioned stereo audio jack 67 by means of suitable positive and negative lead wires 69, 71 and 73, 75. The FIG. 5 embodiment shows the speakers connected to an internally provided amplifier 77 which is powered by a battery pack 79. Such an amplifier can be provided for additional power to the speakers as needed, for example, where eight ohm speakers are used instead of four ohm speakers. Additionally, because the FIG. 5 embodiment is a two-way system wherein the frequencies to each channel are divided between two speakers, such as the two right channel speakers 81, 83, suitable frequency cross-over electronics are provided in the form of capacitors 85, 87 (typically 4.7 microfarad capacitors) in the positive side of the high frequency speakers.

All wiring connections to the speakers should be accomplished without soldering, such as with electrical spoons, and wiring should also be completed before insulation is injected to allow wiring to be insulated as well.

Reference is again made to FIG. 1. To use the recreational cooler and speaker system of the invention, any suitable miniaturized audio source, such as a miniature radio or a minicassette player, or a combination radio and cassette player, is secured to the lid of the cooler by means of the retaining strap 16 attached to the cooler lid 23. To hold the miniature audio device in place, the device is simply placed over the strap and the strap's free end secured over the device by means of a suitable hold down mechanism such as Velcro strips. An audio cable having a suitable end connector plug is then extended from the output of the audio device and inserted into the cooler's audio jack 55 to drive the cooler's side mounted speakers. Other means for holding the audio source to the cooler could also be devised, for example, a molded tray holder in the back of the cooler.

Although the invention has been described above in considerable detail, it should be understood that it is not intended that the invention be limited to such detail, except as may be necessitated by the following claims:

What I claim is:

1. A recreational cooler and speaker system comprising an enclosure having an outer bottom wall, outer side walls and outer end walls, an interior storage compartment, and insulation material between said outer walls and interior compartment, at least one speaker element mounted in one of the outer walls of said enclosure, at least one audio signal input terminal mounted to one of the outer walls of said enclosure, and an electrical conductor path between the outer walls of said cooler enclosure and said interior storage compartment, said conductor path electrically connecting said audio signal output terminal to said speaker element without penetrating said interior compartment whereby the speaker element of the recreational cooler can be driven by an external audio signal source by simply externally connecting same to said input terminal.

2. The recreational cooler and speaker system of claim 1 wherein said audio signal input terminal includes an audio jack adapted to removably receive a mating plug connector.

3. The recreational cooler and speaker system of claim 2 wherein said audio jack is mounted in one end wall of said enclosure.

4. The recreational cooler and speaker system of claim 3 wherein said enclosure include a swivel lid attached at swivel points to the end walls of said enclosure, and wherein said audio jack is disposed through one of said swivel points of said swivel lid.

5. The recreational cooler and speaker system of claim 1 wherein there are at least two speaker elements are provided in one of said enclosure sidewalls, and said electricaal conductor path provides a separate audio channel to each of said speaker elements.

6. The recreational cooler and speaker system of claim 5 wherein at least four speaker elements are provided including a low and high frequency speaker element for each of said audio channels for providing a two way speaker for each channel, said electrical conductor path including electrical means for crossing over the audio signal of each channel from the low frequency speaker element to the high frequency speaker element.

* * * * *

UNITED STATES PATENT AND TRADEMARK OFFICE

CERTIFICATE OF CORRECTION

PATENT NO. : 4,700,395

DATED : October 13, 1987

INVENTOR(S) : Long, Bill

It is certified that error appears in the above—identified patent and that said Letters Patent is hereby corrected as shown below:

In the specification:

Col. 2, line 61, "elements" should be --element--.

Col. 3, line 11, "size" should be --sized--.

line 25, "a" should be --an--.

line 44, "interferring" should be --interfering--.

In the claims:

Claim 4, line 60, "include" should be --includes--.

Claim 5, line 66, the word "are" should be deleted.

Signed and Sealed this

Fifth Day of April, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,700,395

DATED : October 13, 1987

INVENTOR(S) : Bill Long

It is certified that error appears in the above—identified patent and that said Letters Patent is hereby corrected as shown below:

Claim 1, Col. 4, line 46, "output terminal" should be --input terminal--.

Signed and Sealed this

Seventh Day of September, 1993

Bruce Lehman

*Attest:*

BRUCE LEHMAN

*Attesting Officer*

*Commissioner of Patents and Trademarks*